US007629523B2

(12) United States Patent
Neagle

(10) Patent No.: US 7,629,523 B2
(45) Date of Patent: Dec. 8, 2009

(54) FASTENER FREE GUITAR SUPPORTING DEVICE

(76) Inventor: George Neagle, PO Box 1751, Atikokan, ON (CA) P0T 1C0

( * ) Notice: Subject to any disclaimer, the term of this patent is extended or adjusted under 35 U.S.C. 154(b) by 0 days.

(21) Appl. No.: 11/689,075

(22) Filed: Mar. 21, 2007

(65) Prior Publication Data

US 2007/0261532 A1 Nov. 15, 2007

Related U.S. Application Data

(60) Provisional application No. 60/798,726, filed on May 9, 2006.

(51) Int. Cl.
*G10D 3/00* (2006.01)

(52) U.S. Cl. ..... 84/329; 84/327; 84/267

(58) Field of Classification Search ..... 84/327, 84/329, 421, 297 R, 450, 453; D17/14, 20, D17/99

See application file for complete search history.

(56) References Cited

U.S. PATENT DOCUMENTS 4,251,016 A * 2/1981 O'Rafferty et al. ..... 224/250
4,858,801 A 8/1989 Sameniego
5,000,071 A * 3/1991 Thomas ..... 84/327
5,332,137 A * 7/1994 Violette ..... 224/257
5,616,874 A 4/1997 Kraus et al.
6,624,346 B2 * 9/2003 Standish ..... 84/280
2004/0020344 A1 * 2/2004 Bazata ..... 84/327
2004/0094585 A1 * 5/2004 Walker ..... 224/257
2006/0005688 A1 * 1/2006 Miller ..... 84/327

FOREIGN PATENT DOCUMENTS

CA 1104849 7/1981

* cited by examiner

*Primary Examiner*—Jeffrey Donels
*Assistant Examiner*—Christopher Uhlir
(74) *Attorney, Agent, or Firm*—Ade & Company Inc.; Ryan W. Dupuis; Kyle R. Satherthwaite

(57) ABSTRACT

A supporting device for a stringed instrument, for example a guitar, comprises: a cradle portion for spanning the bottom side of the guitar body; a wrap portion for extending over the top side of the guitar body opposite the cradle portion and for being connected to the cradle portion for securing the cradle portion against the bottom side of the guitar body; and a strap portion extending between a first end for connection to the cradle portion opposite the guitar neck and a second end for connection to one of cradle portion or the wrap portion adjacent the guitar neck such that the body is suspended by the strap portion. The cradle portion, wrap portion and strap are formed of soft material without any fasteners required so as not to damage the instrument.

20 Claims, 8 Drawing Sheets

FIG. 11
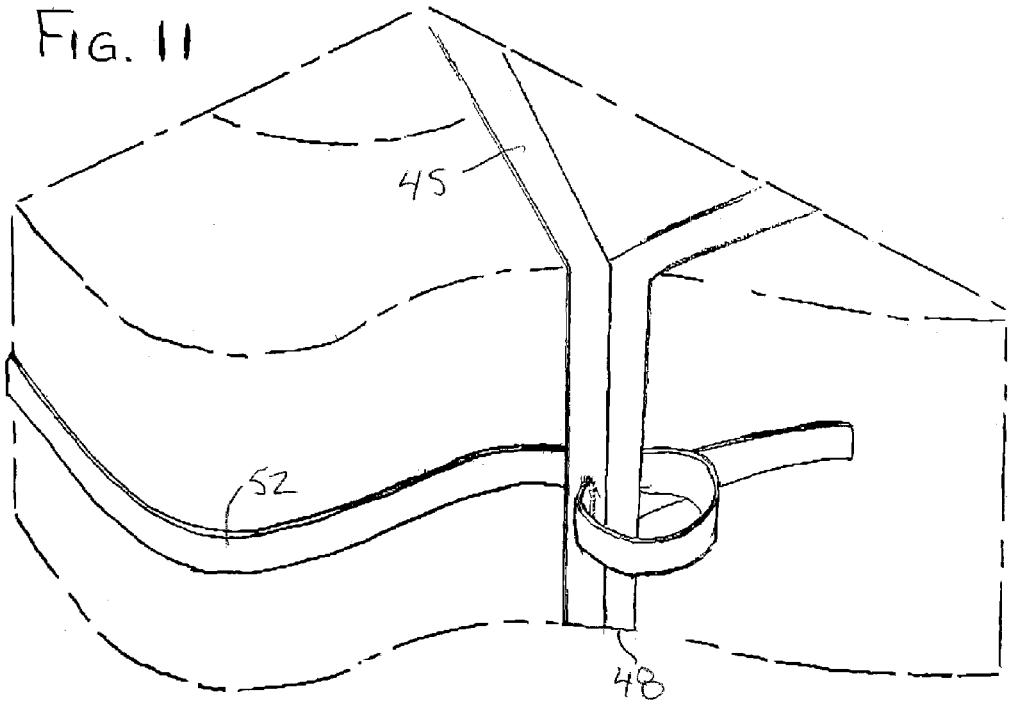
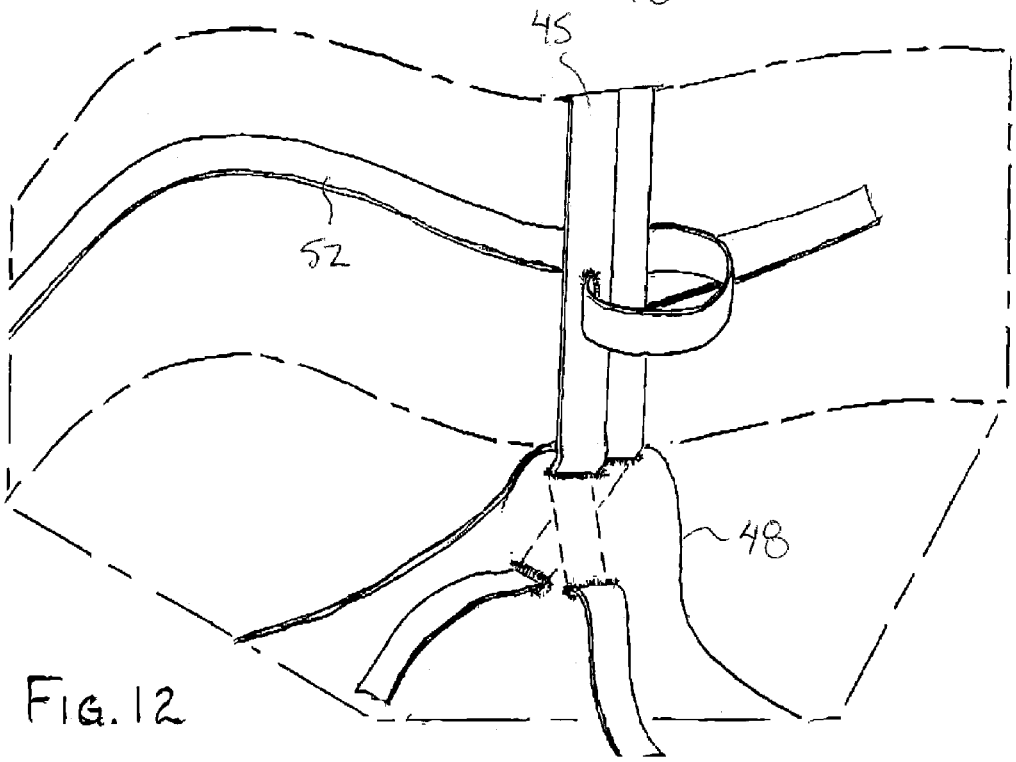
FIG. 12

FASTENER FREE GUITAR SUPPORTING DEVICE

This application claims the benefit under 35 U.S.C. 119(e) of U.S. provisional application Ser. No. 60/798,726, filed May 9, 2006.

FIELD OF THE INVENTION

The present invention relates to a device used to support, suspend or hang an acoustic guitar, or other similar stringed instrument, around a neck of a player without fasteners attached as an integral part of the instrument.

BACKGROUND

In the field of invention of guitar strap technologies, it is common to have strapping come with a guitar for the purpose of physical support for the instrument while it is being played. Various examples of prior art straps are described in the following patent documents: U.S. Pat. No. 5,616,874 (Kraus), US 2004/0094585 (Walker), U.S. Pat. No. 4,858,801 (Sameniego) and CA 1,104,849 (Silverman et al.).

In each instance of the above noted prior art a fastener or peg is required to be installed in the body of the instrument for connection to one end of a strap while the other end is tied to the headstock in order for a strap to be used on classical and most acoustic guitars. Once a prior art guitar strap becomes worn out, it tends to slip off the peg and the instrument can fall with any sudden movement of the player. Installation of pegs or fasteners into the guitar body can also affect the quality of the instrument and may have a negative effect on the instrument's value.

U.S. Pat. No. 4,251,016 (O'Rafferty et al.) discloses an example of a harness for a stringed instrument which is intended to support a guitar without requiring fasteners installed in the body of the guitar. In practice however, insufficient support is provided at the bottom side of the guitar so that the body can slip through the straps of the harness, possibly causing damage to the body of the guitar.

SUMMARY OF THE INVENTION

According to one aspect of the invention there is provided a supporting device for a stringed instrument having: a body with a front face bound by a top side and a bottom side, each extending in a longitudinal direction between a first end and a second end of the body; a neck extending in the longitudinal direction from the second end of the body and strings spanning the front face and the neck, the supporting device comprising:

a cradle portion arranged for spanning at least part of the bottom side of the body from the first end towards the neck at the second end;

a wrap portion arranged for extending over the top side of the body opposite the cradle portion and for being connected to the cradle portion for securing the cradle portion against the bottom side of the body; and a strap portion extending between respective first and second ends and arranged for connection at the first of the strap portion to the cradle portion adjacent the first end of the body and for connection at the second end of the strap portion to one of cradle portion or the wrap portion adjacent the second end of the body such that the body is suspended by the strap portion.

Use of a cradle portion in the supporting device which spans a bottom side of the instrument provides considerably more support than prior art guitar straps while at the same time the supporting device does not require any form of fastener to be inserted into the body of the instrument to also maintain the original integrity of the instrument.

The present invention, referred to herein as the Fastener Free Guitar Support, preferably consists of a length of non-abrasive, low stretch, commercially available, possibly recycled, textile, in a preferably woven or otherwise tie down strap type material. It would be tied at one end in a loop cinch configuration and a series of small pieces of the same material, referred to as "P" in the drawings, would be fixed, fastened, woven, tied, glued, sewn or secured to the main length in specific places depending on the style of support. The measurements would vary due to availability of materials and size differences between different manufacturers. As there are no fasteners, buckles, or clips, there is no possibility of scratching or wearing out the finish on a high end instrument. The harness can be removed for maintenance and cleaning. Although some type of fastener may or may not be incorporated into design as unknown technologies will become known. If the instrument was inverted and shaken, there would be a problem of support as the instrument should only be held by the straps. As the support is being used, it tends to lean the guitar frontward; however this can be remedied by connecting the final part of body (designated as B41 in FIG. 8) to the face of the instrument from the upper bridge side.

The portions of the supporting device and any connecting members coupled therebetween preferably consist only of soft and flexible materials.

The wrap portion may span across both the front face and a rear face of the body of the instrument.

Preferably, the wrap portion includes a middle wrap which extends about the body of the instrument between the first and second ends thereof.

The wrap portion may further include a middle wrap which spans the front face of the body between the body and the stings.

The wrap portion may also include a middle wrap which spans both the front face and a rear face of the body centrally between the first and second ends thereof.

When used for a stringed instrument having a body with a narrow middle portion of reduced dimension between the top and bottom sides thereof, the wrap portion preferably includes a middle wrap extending about the body at the narrow middle portion thereof.

The wrap potion may include an end wrap spanning between the cradle portion at the first end of the body and a middle wrap extending about the body between the first and second ends thereof. Preferably, the end wrap spans the front face of the body.

The wrap portion may include an end wrap which spans a rear face of the body between the first end and the second end thereof in the longitudinal direction.

The wrap portion preferably includes a retainer wrap which spans at least a front face of the body between opposed ends of the cradle portion.

The retainer wrap may span both the front face and a rear face of the body a full length of the body between the first and second ends thereof.

The cradle portion may span from the first end of the body only partway towards the second end of the body with the wrap portion extending between the cradle portion and the second end of the body.

The cradle portion may span a full length of the bottom side of the body between the first and second ends thereof.

The cradle portion and the wrap portion may be formed integrally with one another.

Some embodiments of the invention will now be described in conjunction with the accompanying drawings.

BRIEF DESCRIPTION OF THE DRAWINGS

FIG. 11 and FIG. 12 and perspective views of the wrap portion along the top side of the guitar showing front and rear faces of the guitar respectively according to the second embodiment.

In the drawings like characters of reference indicate corresponding parts in the different figures.

DETAILED DESCRIPTION

Figure 1:
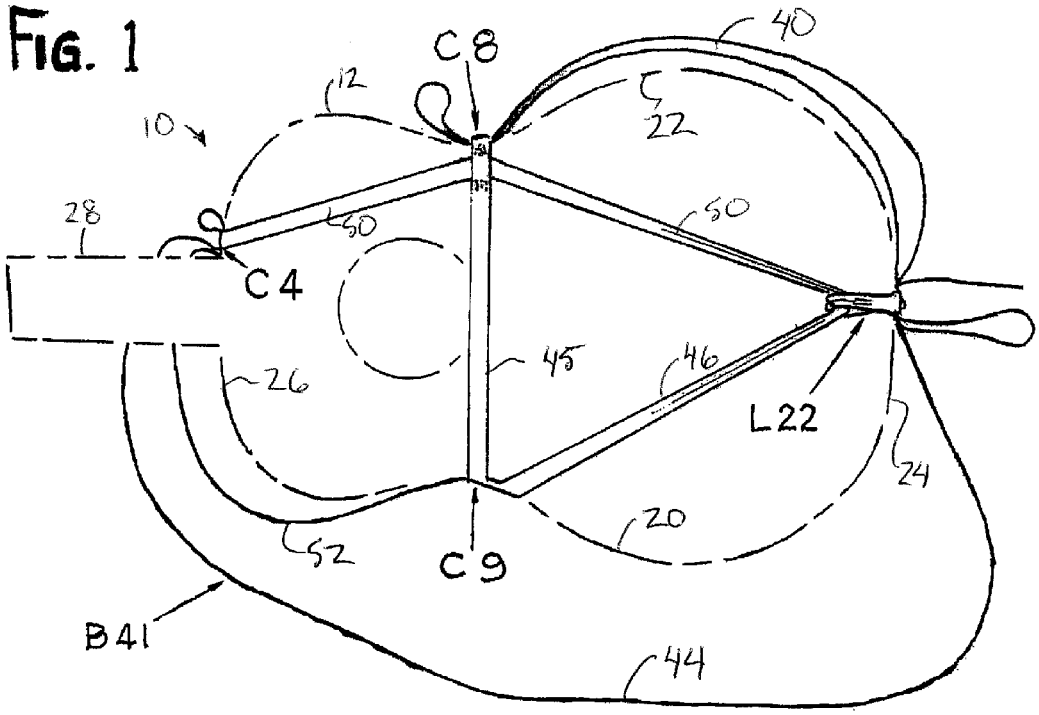
FIG. 1 is a front elevational view of a first embodiment of the guitar supporting device before the straps are pulled tight across the instrument.

Referring to the accompanying drawings there is illustrated guitar supporting device generally indicated by reference numeral 10. The device is particularly suited for supporting a stringed instrument 12, for example a guitar. The instrument typically has a body 14 including a flat front face 16 and an opposing rear face 18 which are joined along opposing sides by a top side 20 and a bottom side 22 extending between the front and rear faces and which span in a longitudinal direction of the body from a first end 24 to a second end 26 of the body. The instrument further includes a neck 28 extending from the second end of the body in the longitudinal direction. Strings are provided which span the front face 16 and the neck 18. The body 14 includes a narrow middle portion 30 in which a height of the body between the top and bottom sides is narrower in dimension than the height nearer to either of the first and second ends of the body.

Although two embodiments of the supporting device 10 are shown in the accompanying figures, the common features of both embodiments will first be described herein. In each instance the supporting device includes a cradle portion 40 which is supported to span along the bottom side of the body from a first end of the cradle portion at the first end of the body in the longitudinal direction to a second end of the cradle portion towards the neck mounted at the second end of the body. A wrap portion 42 is connected to the cradle portion 40 for extending over the top side of the body opposite the cradle portion 40 and for being connected to the cradle portion such that the cradle portion is secured against the bottom side of the body with the body of the instrument being supported thereon. A strap portion 44 can thus be secured to the wrap portion 42 and the cradle portion 40 in which the strap portion has a suitable length for being worn about the neck of a user which desires to suspend the body of the instrument in a suitable position for playing the instrument.

The wrap portion 42 spans both the front and rear faces of the body of the instrument. The wrap portion and the cradle portion are all formed of soft and non-abrasive materials so that these portions along with any connections therebetween include no additional rigid or abrasive fasteners which might harm the finish of the instrument being supported.

The wrap portion 42 includes a middle wrap 45 which extends fully about the body of the guitar around the narrow middle portion 30 thereof to span both the front and rear faces of the guitar body while extending over the top side 20 thereof. The middle wrap 45 comprises a flat member which can be received between the strings and the front face of the body.

The wrap portion 42 also includes a first end front wrap 46 which extends across the front face of the body from the first end of the cradle portion 40 adjacent the first end of the body to the middle wrap 44 at the top side 20 of the body.

A rear wrap 48 spans the rear face of the body between the first end of the cradle portion 40 at the first end of the body and the second end of the body adjacent the neck 28.

A retainer wrap 50 spans at least the front face 16 of the body between the first end of the cradle portion 40 adjacent the first end of the body and the middle wrap 44 at the bottom side 22 of the body as well as spanning the front face between the middle wrap 44 at the bottom side 22 and the second end of the body adjacent the neck 28. The rear wrap 48 accordingly is connected between the retainer wrap 50 at the first end of the body and the retainer wrap at the second end of the body across the rear face of the body.

A second end front wrap 52 spans over the top side 20 of the body from the middle wrap 44 at the top side to the second end of the body where the retainer wrap and the first end rear wrap 48 are also joined. All of the wraps of the wrap portion 42 accordingly serve to hold the cradle portion 40 snug against the bottom side of the body to prevent any slippage of the instrument falling through between the wrap portion 42 and the cradle portion 40 of the supporting device.

The strap portion 44 extends between respective first and second ends which are connected to the wrap portion and the cradle portion at the respective first and second ends of the body such that the body is suspended by the strap portion when the wrap portion and the cradle portion are secured snugly about the body of the instrument.

Turning now more particularly to the first embodiment illustrated in FIGS. 1 through 8, the cradle portion 40, the wrap portion 42 and the strap portion 44 are all formed of a continuous long strap member which is attached in sections by wrapping, sewing or knotting about the body of the instrument. The cradle portion 40 in this instance spans the bottom side of the body form the first end to the second end of the cradle portion at the narrow middle portion 30. The retainer wrap 50 accordingly also comprises narrow straps which join the straps of the cradle and wrap portions to ensure that the body of the guitar remains secured and suspended above the cradle portion.

Turning now to the second embodiment illustrated in FIGS. 9 through 13, the cradle portion 40, the wrap portion 42 and the strap portion 44 are all formed integrally with one another of a sheeted material so as to be substantially free of additional fastening means including some of the knotting and stitching required in the first embodiment. The cradle portion 40 in this instance may comprise a continuous sheeted member spanning the full bottom side of the guitar body from the first end to the second end thereof as well as extending continuously from the bottom side up and over to a lower potion of the front and rear faces. The sheeted material preferably comprises a type of textile, for example anything from spandex to canvas.

The material is mainly sewn and tied and no additional hardware of any kind including rigid fasteners or suction cups are required for installation. The thickness of the material forming the straps or the sheeted material in either embodiment may be doubled in thickness at some locations and re-sewn for additional strength if desired.

Turning now more particularly to the first embodiment again, the method of attaching the supporting device 10 to the guitar will now be described in further detail.

FIG. 1 is a frontal view of the support installed but not tightened to show positioning and placement of most patches and loops in which L=Loop, C=Corner, P=Patch, B=Body, and T=Tie.

Figure 2:
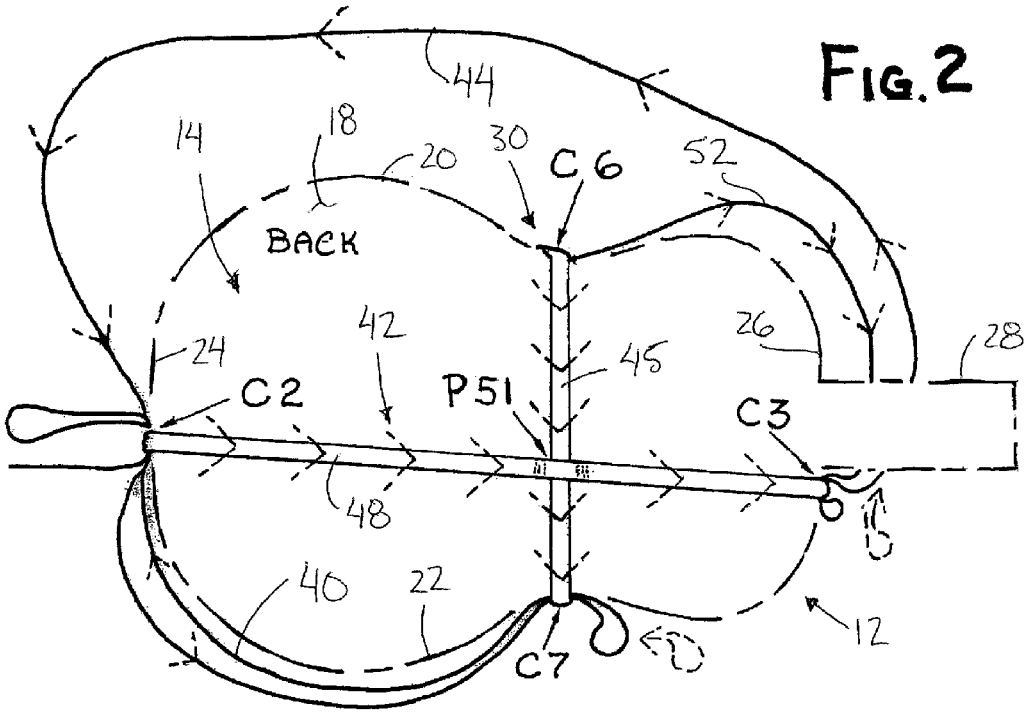
FIG. 2 is a rear elevational view of the device of FIG. 1.

FIG. 2 is a back or rear view showing a back of the instrument and intersection at P 51, FIG. 2 and general loose placement. Also corners 2, 3, 6, 7 are shown and a partial frontal perspective also labels the back and a direction of wrap 1 and 2 with arrows.

Figure 3:
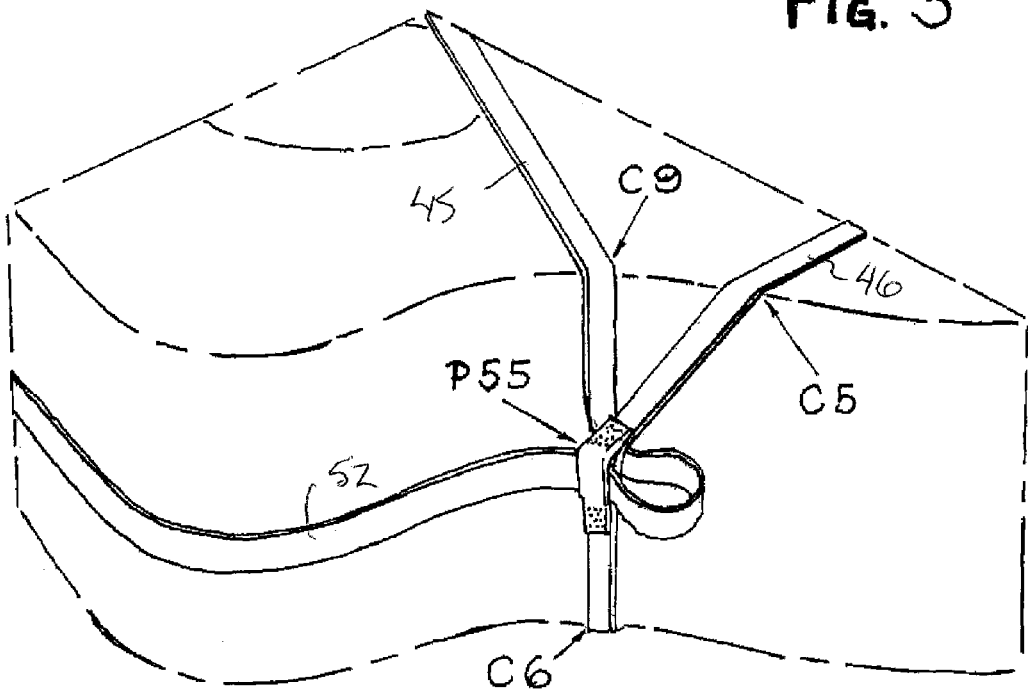
FIG. 3 is a perspective view of a bottom side connection of the device of FIG. 1.

FIG. 3 is a top side view of a patch at P 55 shown loose for illustration of the strap and patch placement. Corners 5, 6, and 9 are also shown.

Figure 4:
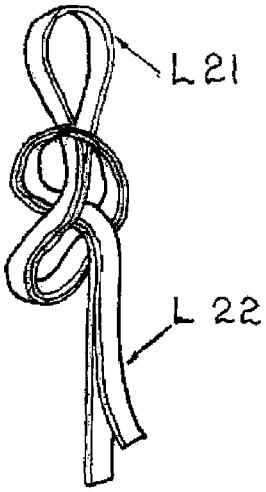
FIG. 4 is a perspective view of a connection at the first end of the device of FIG. 1, opposite the neck of the instrument.

FIG. 4 is a front view of a first loop knot tied on the strap, shown loose and larger for illustration of loop L 21.

Figure 5:
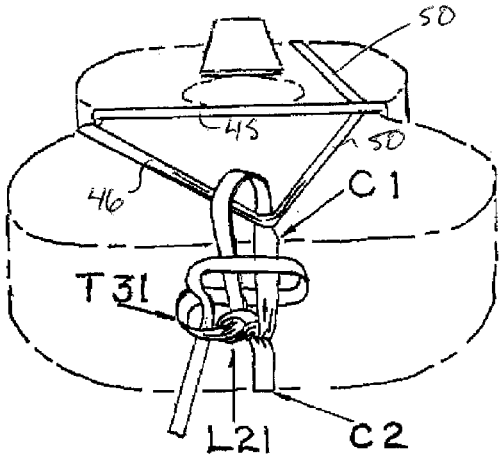
FIG. 5 is a perspective view of the connection of FIG. 4 shown during assembly on the instrument.

FIG. 5 is a bottom, base, bridge, or tail perspective view of a relationship between the tie T 31, and loop L 21. The tie 31 can be completed twice. Corners C 1 and C 2 are also shown.

Figure 6:
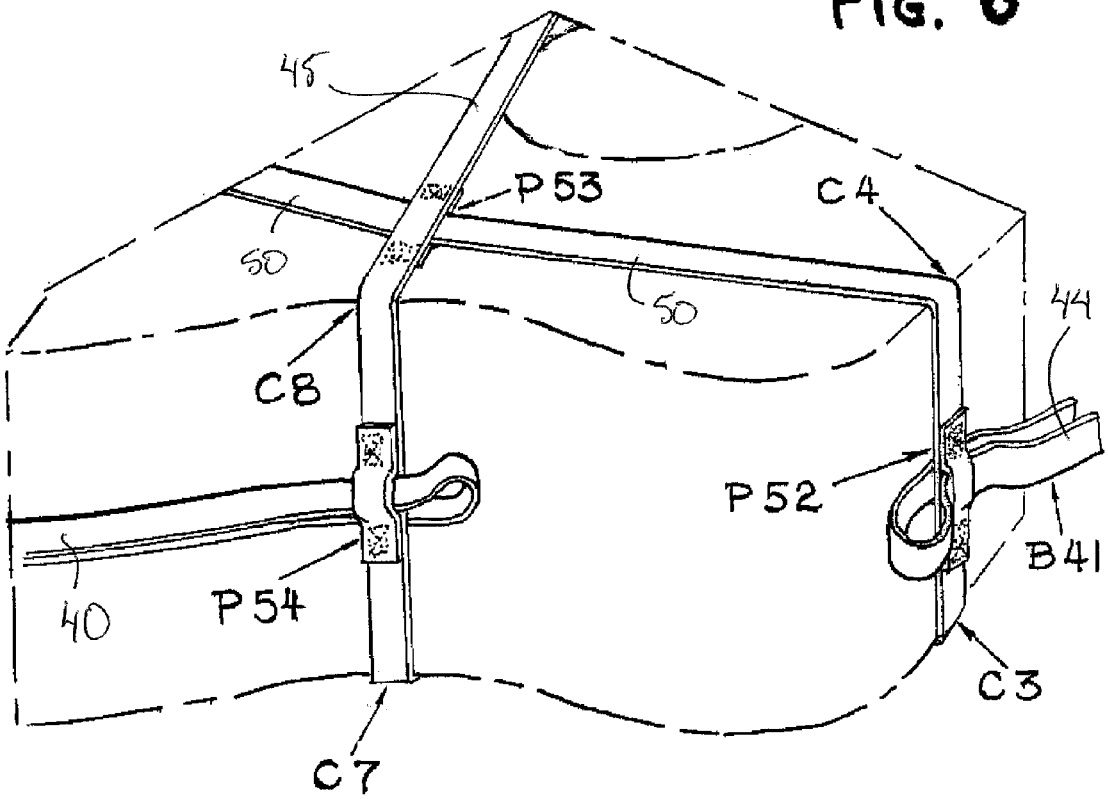
FIG. 6 is a perspective view of a top side connection of the device of FIG. 1.

FIG. 6 is a partial frontal bottom, side perspective view showing three patches, P 52, 53, and 54. P 52 and 54 are shown with loops at a directional change which would not be seen when fully installed. Corners 3, 4, 7, and 8 are also shown.

Figure 7:
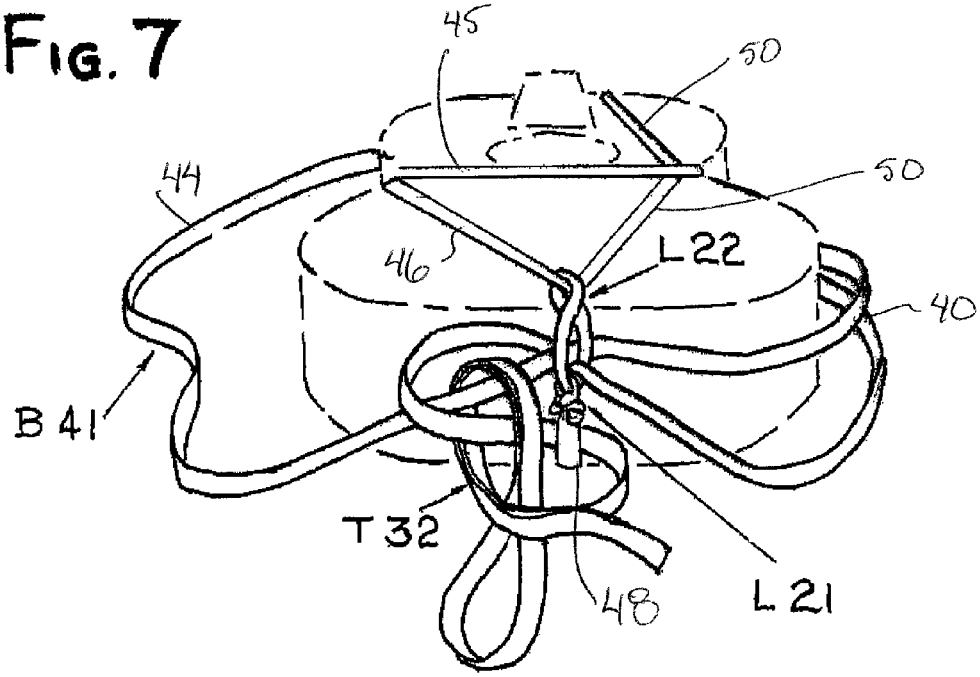
FIG. 7 is a perspective view of the first end of the device of FIG. 1, opposite the neck of the instrument, part way through installation on the instrument.

FIG. 7 is a bottom side or bridge perspective view showing the support near completion with tie 32 loose and the placement of strap, shown larger than actual size for clarity. Loop 21 and 22, body loop 41 are also shown.

Figure 8:
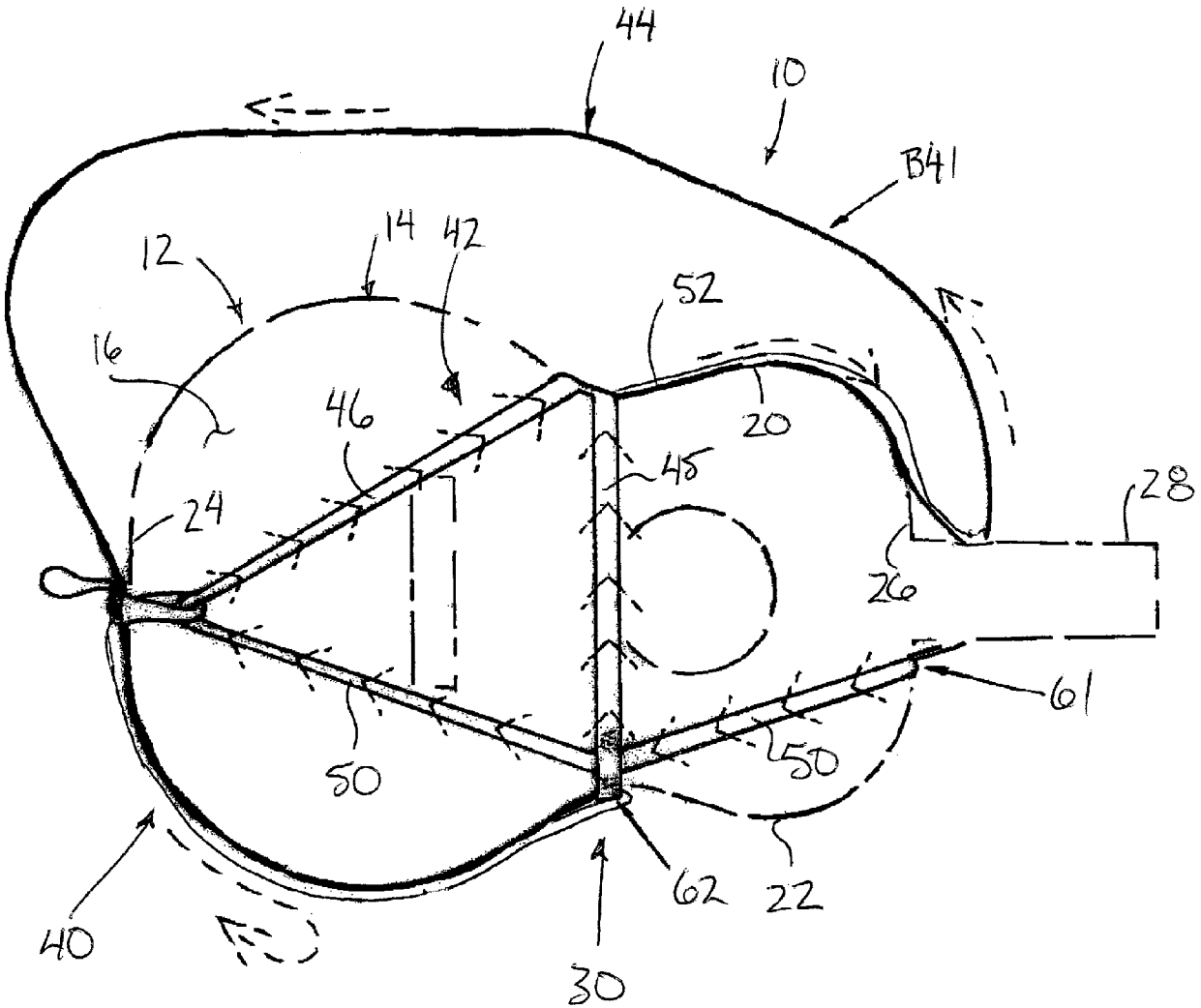
FIG. 8 is a front elevational view of the first embodiment of the guitar supporting device once the device has been assembled snugly about the instrument.
Figure 9:
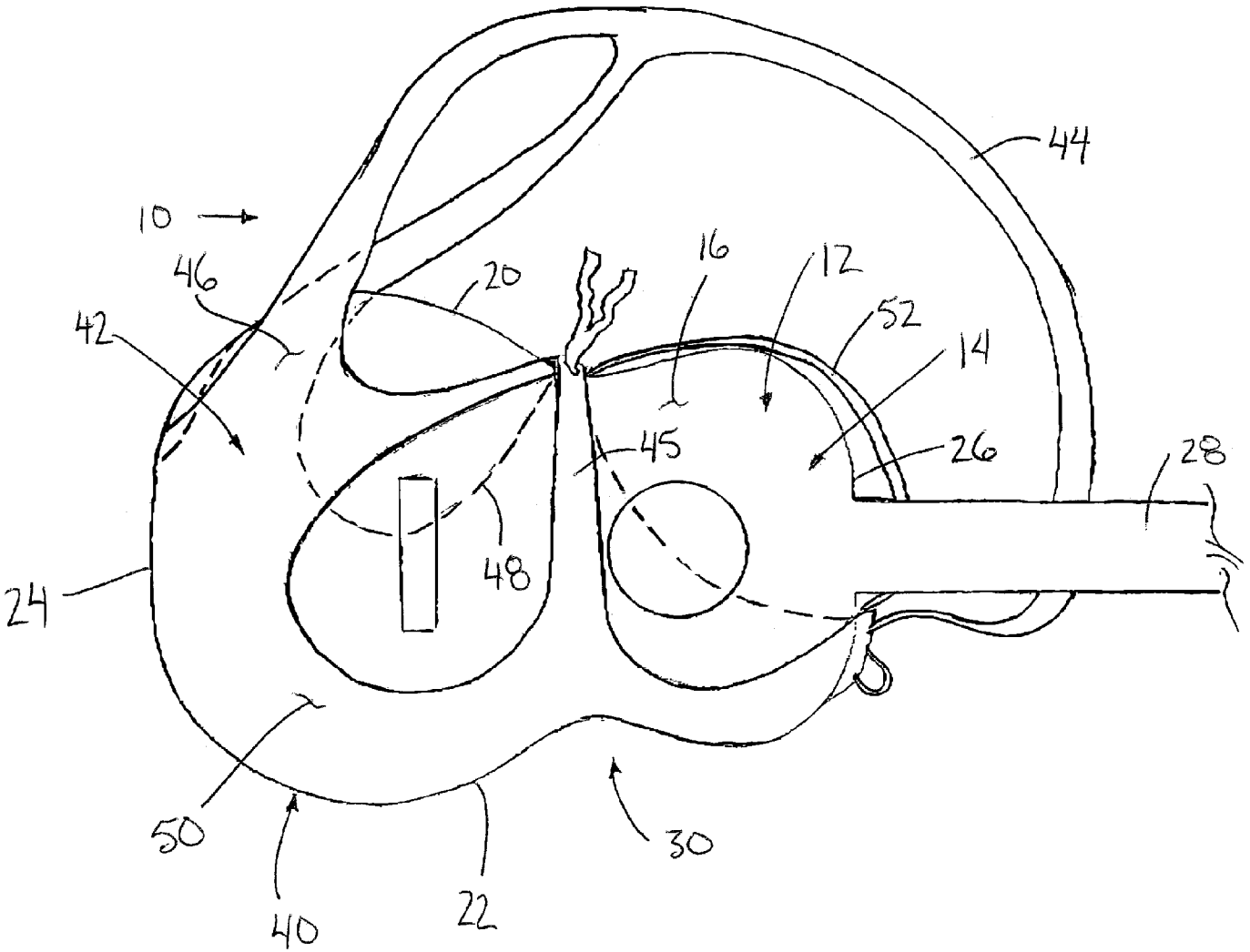
FIG. 9 is a front elevational view of a second embodiment of the guitar supporting device.
Figure 10:
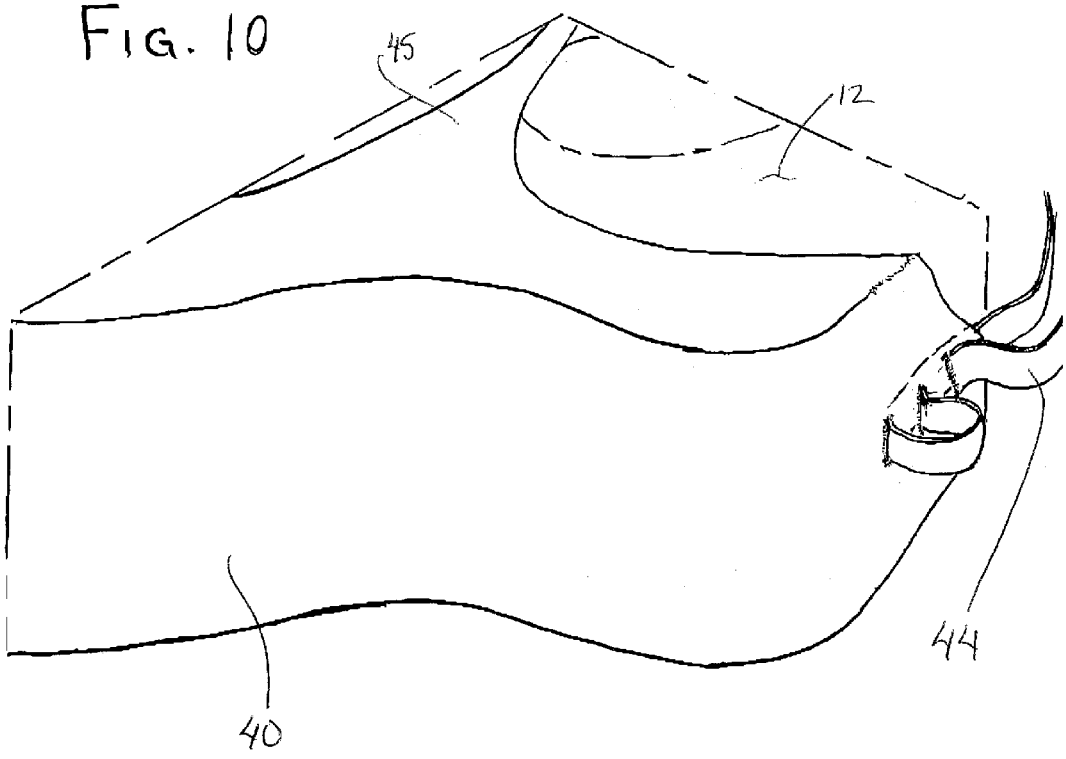
FIG. 10 is a perspective view of the cradle portion adjacent the neck of the guitar according to the second embodiment.
Figure 13:
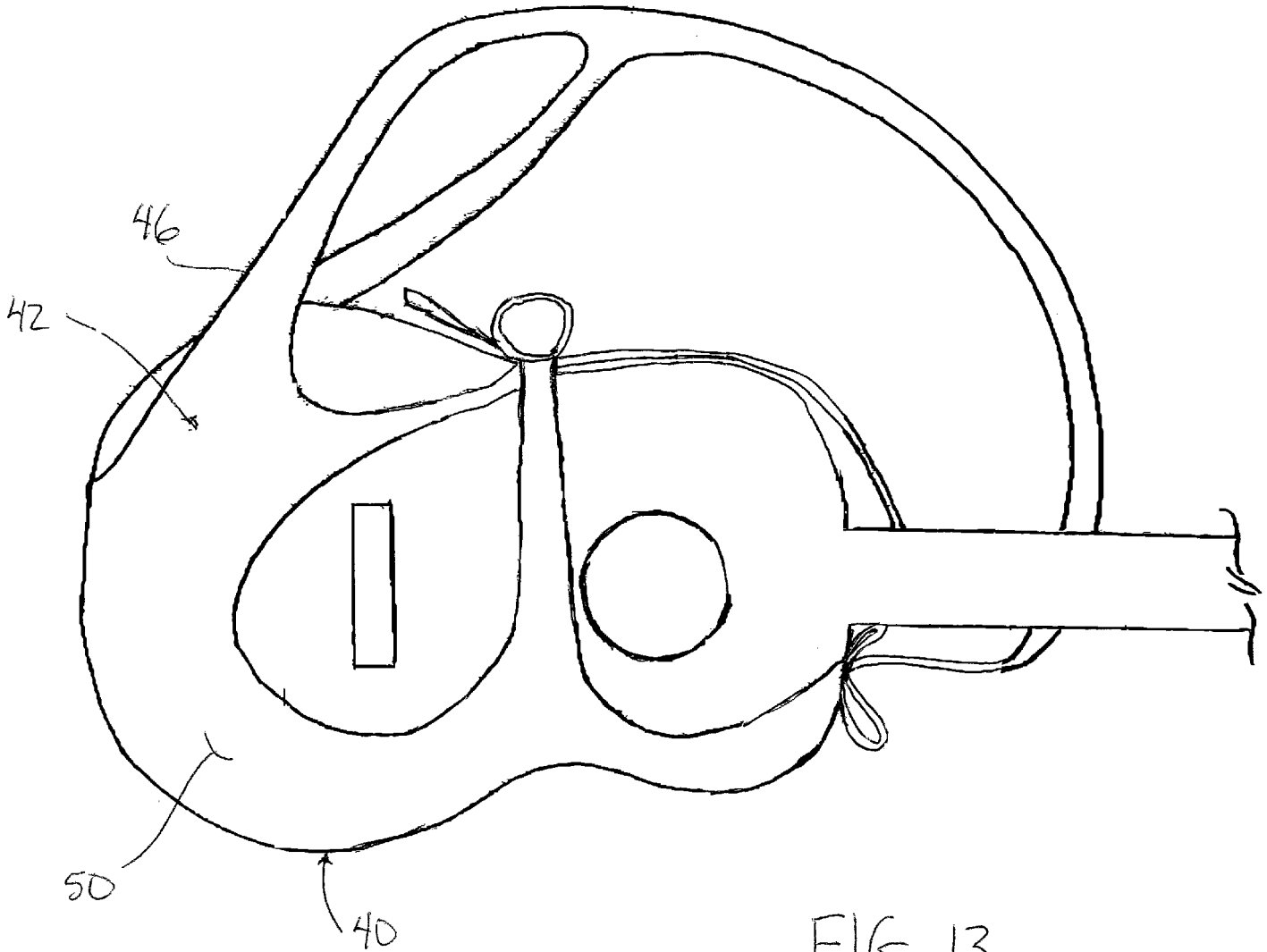
FIG. 13 is a front elevational view of the second embodiment in a partially assembled condition.

FIG. 8 is a face view and shows the Fastener Free Guitar Support installed and trimmed, identifying body loop 41 where the user would support the instrument B 41. FIG. 8 also identifies wrap 1 and 2, directional hidden line arrows and main body parts as named throughout the disclosure as the face, the top side, the bottom side, the tail, the bridge end, and the front side.

FIG. 1 shows support near completion in which the final knot is left untied as a means to show intersections and direction of application W 1 and 2. A length of non-abrasive low or no stretch commercially available possibly recycled tie down strap type material or textile is tied at one end in a loop cinch knot configuration then laid out on a flat surface with the loop being the closest end. A guitar is then laid on top, face up, while holding the strap between two fingers to keep it flat to the guitar at all times. The strap is drawn back over the body of the guitar 180°, passing along the underside of the neck around corners C 34 and C 4 (FIG. 6) and loop W 1, to return to the first knot around and through loop T 31 (FIG. 5), which is not tightened at this point. As the strap changes direction again it travels to the upper body arch of a right handed guitar. There it would drop over the side at a variable angle due to the style of guitar and support to allow the strap to go around the back of the guitar C 5, C 6 (FIG. 3) at which point it would pass itself where it was first laid down at approximately 90°. A pin would service as a temporary clamp (pin not shown) at this point P 51 (FIG. 2) continuing to keep the strap flat, back over the face of the guitar C7, C8 (FIG. 6) and under the strings in route to passing the first wrap again at approximately 90° at point P 53 (FIG. 6). Again it would drop over the side, C9 (FIG. 3) to pass under the end of the first wrap. Approximately one revolution equals one wrap of the strap support under the beginning of previously placed strap, wrap 1. At approximately halfway along the side P 55 (FIG. 3) the strap is pinned again. The strap then travels laterally along the upper side toward the headstock of the instrument tuning peg direction under the neck, P. 52 (FIG. 6), again passing under the first wrap. Here a pin would temporarily hold the strap in place (pin not shown). After being sure the strap is flat all the way around the guitar and is snugged up, the tie 31 (FIG. 5) can be completed for more tightening. Where the pins have been used are the places where permanent fittings may be applied. Fasteners or temporarily secured fittings like stick together materials, buckles or snaps may wear or damage finish on the instrument and/or eventually wear out or break. Future fasteners may or may not be incorporated into the design because of unknown technologies. To remedy this, a piece of the same material is sewn in such a fashion as to supply a free moving intersection to allow for further adjustment, as guitars vary in shape and size. One notable area is the junction where the first wrap 1 (FIG. 8) comes in contact with the second wrap 2, on the face of the guitar at the playing area. Here the first strap wrap would be pulled away from the playing area and sewn with one of these patches to the second wrap holding it away from playing area and bridge. The piece of strap which was passed under the neck B 41 (FIG. 1) can be put over a user's shoulders and basically be sized by passing the remainder of the strap under the double loop cinch knot and holding. A pin again may help. At the bridge end of the guitar, the strap may be carefully removed from the user. The strap may then be pulled laterally along the bottom side of a right handed guitar toward the lower body arch to pass it under the second wrap 2, P 54 (FIG. 6), at which point it would be turned back over itself going around the second wrap 180°, through P54 to return it to the bridge bottom side end of the guitar where it is tied in such a way as to not let it slide up, keeping a more centred support and locking the body loop in position, B 41 (FIG. 7), where a guitar could fall through if inverted and shaken.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A supporting device in combination with a stringed instrument, the stringed instrument comprising: a body with a front face and a rear face joined by a top side and a bottom side extending between the front and rear faces in which each of the top and bottom sides extends in a longitudinal direction between a first end and a second end of the body; a neck extending in the longitudinal direction from the second end of the body and strings spanning the front face and the neck, and the supporting device comprising:

a cradle portion spanning wholly along the bottom side of the body from a first end of the cradle portion at the first end of the body in the longitudinal direction to a second end of the cradle portion towards the neck at the second end of the body;

a wrap portion extending over the top side of the body opposite the cradle portion and being connected to the cradle portion so as to be arranged to secure the cradle portion along the bottom side of the body;

the wrap portion extending fully about the body of the stringed instrument so as to be arranged to retain the cradle portion spanning wholly along the bottom side of the body from the first end of the body towards the neck at the second end of the body;

the cradle portion being wholly located along the bottom side of the body spanning in the longitudinal direction from the first end of the body of the stringed instrument by the wrap portion; and a strap portion extending between respective first and second ends and being connected at the first end of the strap portion to the cradle portion adjacent the first end of the body and being connected at the second end of the strap portion to one of cradle portion or the wrap portion adjacent the second end of the body such that the body is arranged to be suspended by the strap portion;

the wrap portion comprising strap member sections wrapped about the body of the stringed instrument such the wrap portion is secured about the body of the stringed instrument only by the strap member sections without any rigid fasteners; and the cradle portion being wholly located along the bottom side of the body of the stringed instrument and secured to the body only by the strap member sections without use of any rigid fasteners.

2. The combination according to claim 1 wherein the portions of the supporting device and any connecting members coupled therebetween consist only of soft and flexible materials.

3. The combination according to claim 1 wherein the wrap portion spans across both the front face and a rear face of the body of the instrument.

4. The combination according to claim 1 wherein the wrap portion includes a middle wrap which extends about the body of the instrument between the first and second ends thereof.

5. The combination according to claim 1 wherein the wrap portion includes a middle wrap which spans the front face of the body between the body and the stings.

6. The combination according to claim 1 wherein the wrap portion includes a middle wrap which spans both the front face and a rear face of the body centrally between the first and second ends thereof.

7. The combination according to claim 1 for a stringed instrument having a body with a narrow middle portion of reduced dimension between the top and bottom sides thereof wherein the wrap portion includes a middle wrap extending about the body at the narrow middle portion thereof.

8. The combination according to claim 1 wherein the wrap portion includes an end wrap spanning between the cradle portion at the first end of the body and a middle wrap extending about the body between the first and second ends thereof.

9. The combination according to claim 8 wherein the end wrap spans the front face of the body.

10. The combination according to claim 1 wherein the wrap portion includes an end wrap which spans a rear face of the body between the first end and the second end thereof in the longitudinal direction.

11. The combination according to claim 1 wherein the wrap portion includes a retainer wrap which spans at least a front face of the body between opposed ends of the cradle portion.

12. The combination according to claim 11 wherein the retainer wrap spans both the front face and a rear face of the body.

13. The combination according to claim 11 wherein the retainer wrap spans a full length of the body between the first and second ends thereof.

14. The combination according to claim 1 wherein the cradle portion spans along the bottom side from the first end of the body only partway towards the second end of the body and wherein the wrap portion extends between the cradle portion and the second end of the body.

15. The combination according to claim 1 wherein the cradle portion spans a full length of the bottom side of the body between the first and second ends thereof.

16. The combination according to claim 1 wherein the cradle portion and the wrap portion are formed integrally with one another.

17. The combination according to claim 1 wherein the wrap portion includes a front wrap extending across the front face of the body from the first end towards the second end of the body and a rear wrap spanning across the rear face of the body from the first end towards the second end of the body.

18. The combination according to claim 1 wherein the stringed instrument comprises a narrow middle portion in which a height of the body between the top side and the bottom side is narrower in dimension at the narrow middle portion than a height between the top side and the bottom side nearer to the first end and nearer to the second end of the body and wherein the cradle portion extends in the longitudinal direction wholly along the bottom side from the first end of the cradle portion at the first end of the body to the second end of the cradle portion at the narrow middle portion of the body.

19. The combination according to claim 1 wherein the cradle portion is wholly located along the bottom side of the body of the stringed instrument and secured only by the strap member sections of the wrap portion without any rigid fasteners and without any form of fastener inserted into the body of the instrument.

20. The combination according to claim 1 wherein the cradle portion is wholly located along the bottom side of the body of the stringed instrument and secured only by the strap member sections of the wrap portion and wherein connection of the wrap portion and the cradle portion about the body is limited to wrapping, sewing and knotting.

* * * * *